US009834326B2

(12) United States Patent
Wusatowska-Sarnek et al.

(10) Patent No.: US 9,834,326 B2
(45) Date of Patent: Dec. 5, 2017

(54) METHOD FOR ELIMINATION OF POWDER SEGREGATION DURING CAN FILLING

(71) Applicant: United Technologies Corporation, Hartford, CT (US)

(72) Inventors: Agnieszka M. Wusatowska-Sarnek, Mansfield Center, CT (US); James S. Guest, Columbus, GA (US); Larry G. Housefield, Portland, CT (US); Enrique E. Montero, Marlborough, CT (US); Ruston M. Moore, Clinton, NY (US)

(73) Assignee: United Technologies Corporation, Farmington, CT (US)

( * ) Notice: Subject to any disclaimer, the term of this patent is extended or adjusted under 35 U.S.C. 154(b) by 0 days.

(21) Appl. No.: 14/786,838

(22) PCT Filed: Apr. 11, 2014

(86) PCT No.: PCT/US2014/033723

§ 371 (c)(1),
(2) Date: Oct. 23, 2015

(87) PCT Pub. No.: WO2014/176043

PCT Pub. Date: Oct. 30, 2014

(65) Prior Publication Data

US 2016/0068282 A1 Mar. 10, 2016

Related U.S. Application Data

(60) Provisional application No. 61/815,358, filed on Apr. 24, 2013.

(51) Int. Cl.
*B65B 1/06* (2006.01)
*B22F 3/00* (2006.01)
(Continued)

(52) U.S. Cl.
CPC ..... *B65B 1/06* (2013.01); *B22F 1/00* (2013.01); *B22F 3/004* (2013.01); *B65B 1/26* (2013.01);
(Continued)

(58) Field of Classification Search
CPC .... B65B 1/06; B65B 1/08; B65B 1/10; B65B 1/16; B65B 1/20; B65B 1/22; B65B 1/26; B65B 1/28; B22F 1/00; B22F 2999/00
(Continued)

(56) References Cited

U.S. PATENT DOCUMENTS 2,142,990 A * 1/1939 Belcher ..... B65B 39/04 141/256
2,985,201 A * 5/1961 Baker ..... B01J 3/006 141/12
(Continued)

FOREIGN PATENT DOCUMENTS

EP 0799662 A2 10/1997
GB 711363 7/1951
(Continued)

OTHER PUBLICATIONS

International Search Report and Written Opinion from PCT Application Serial No. PCT/US2014/033723, dated Aug. 7, 2014, 14 pages.
(Continued)

*Primary Examiner* — Timothy L Maust
(74) *Attorney, Agent, or Firm* — Kinney & Lange, P.A.

(57) ABSTRACT

A powder filling method includes introducing a tube into a can so that the lower end of the tube is near the bottom of the can. The powder in the can is introduced through the tube. The proximity of the lower end of the tube to the powder is controlled by retracting the tube as the powder fills the can.

20 Claims, 3 Drawing Sheets

(51) Int. Cl.

| | |
|---|---|
| ***B22F 1/00*** | (2006.01) |
| ***B65B 1/48*** | (2006.01) |
| ***B65B 39/12*** | (2006.01) |
| ***B65B 1/26*** | (2006.01) |
| *B65B 1/22* | (2006.01) |

(52) U.S. Cl.
CPC ..... *B65B 1/48* (2013.01); *B65B 39/12* (2013.01); *B22F 2999/00* (2013.01); *B65B 1/22* (2013.01)

(58) Field of Classification Search
USPC ..... 141/66, 69, 73, 260, 262, 275, 284, 374; 53/408
See application file for complete search history.

(56) References Cited

U.S. PATENT DOCUMENTS 3,069,734 A * 12/1962 Leuthner ..... A23L 3/00 422/294
3,300,849 A * 1/1967 Wiseman ..... G01N 30/56 141/12
3,716,081 A * 2/1973 Landreville ..... B65B 1/24 100/295
3,838,716 A * 10/1974 Ripple ..... B65B 1/22 141/12
4,121,632 A * 10/1978 Zehr ..... F17C 5/00 141/378
4,185,669 A * 1/1980 Jevakohoff ..... B65B 39/04 141/263
4,972,884 A * 11/1990 Souers ..... B65G 69/0458 141/1
5,039,476 A 8/1991 Adachi et al.
5,316,056 A * 5/1994 Stott ..... B65B 1/28 141/286
5,687,780 A * 11/1997 Minami ..... B01J 8/002 141/1
5,906,229 A * 5/1999 Haquet ..... B01J 8/003 141/237
6,019,147 A * 2/2000 Prescott ..... B65G 69/181 141/114
6,196,278 B1 * 3/2001 Wegman ..... B65B 1/08 141/256
6,843,282 B2 * 1/2005 Bates ..... B65B 1/26 141/12
6,863,096 B2 * 3/2005 Amano ..... B65B 1/26 141/59
7,470,394 B2 12/2008 Al-Shawi
7,946,315 B2 * 5/2011 Schroeder ..... B65G 69/0458 141/12

FOREIGN PATENT DOCUMENTS

JP 3033861 B2 4/2000
KR 20090068720 A 6/2009

OTHER PUBLICATIONS

Extended European Search Report, for European Patent Application No. 14787466.3, dated Dec. 9, 2016, 7 pages.

* cited by examiner

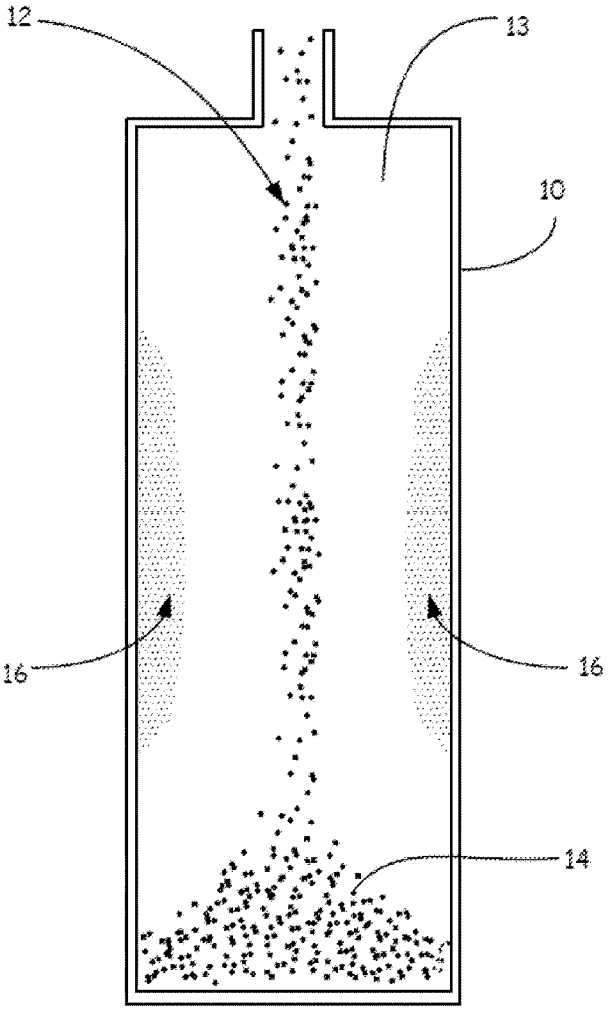
FIG. 1 - PRIOR ART

METHOD FOR ELIMINATION OF POWDER SEGREGATION DURING CAN FILLING

BACKGROUND

This invention relates generally to the field of manufacturing. In particular, the present invention relates to the preparation of metallic alloy powder used to create either hot isostatically pressed or extruded metallic alloy logs that are subsequently converted through additional thermomechanical processing and machining into aerospace products, but this invention is also applicable to any product that employ powder constituents as raw material anywhere during its manufacturing process (for example pharmaceuticals, pigment, electronics, catalysts, and others).

In preparation for manufacturing, a powder, composed of the particles of a given and rather broad distribution, is introduced through an opening at the top of a can. It falls through an atmosphere in the can, and as it free falls it creates a pyramid shaped cone at the bottom of the can. During the free-fall the powder particles segregate due to the size differentiation (as defined by kinetics-of-flow). The segregation further progresses during the formation of the cone, the coarse particles may be free-flowing while the finer particles can be cohesive with a tendency to accumulate in the center of the cone. In addition, very fine particles are suspended in the can atmosphere and due to the electrostatic attraction to the can walls will with time adhere to the can walls. However, the very fine particles may detach from the walls and fall to the bottom of the can in clumps to further segregate the powder in the cone.

This segregation leads to non-homogeneity in a final manufacturing product due to the variability in microstructure and properties of the powder. This non-homogeneity may ultimately result in a final manufacturing product not matching the desired specification. Non-homogeneity of final product is typically undesirable in the final product of metallic alloy powders.

SUMMARY

A powder filling method includes introducing a tube into a can so that the lower end of the tube is near the bottom of the can. The powder in the can is introduced through the tube. The proximity of the lower end of the tube to the powder is controlled by retracting the tube as the powder fills the can.

A powder filling method includes introducing a tube into a can. The powder is supplied through the tube to fill the can. The tube is retracted as the powder fills the can to maintain a consistent distance between the lower end of the tube and the powder. The powder in the can is agitated through rotary agitation.

BRIEF DESCRIPTION OF THE DRAWINGS

FIG. 1 is a schematic view of a prior art can for preparing powder for a next production step.

DETAILED DESCRIPTION

Figure 2B:
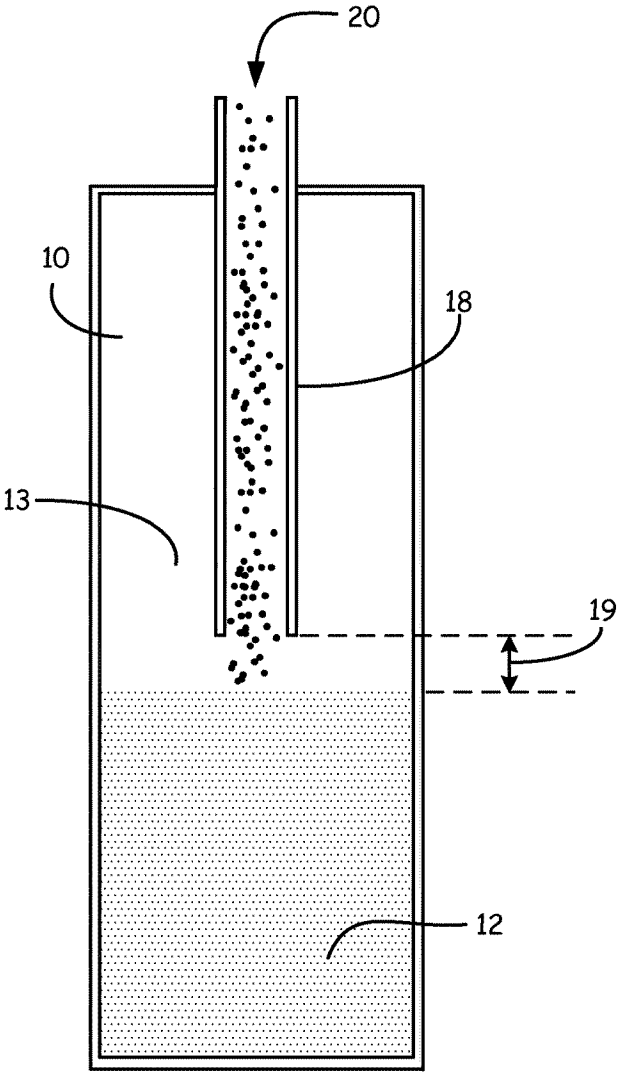
FIG. 2B is a schematic view of a can for preparing powder for a next production step according to a first embodiment of the present invention.

FIG. 1 is a schematic view of a prior art can 10 for preparing powder for a next production step. Powder 12 is introduced through the top of can 10 and falls to the bottom of can 10. Powder 12 may include any material, such as powdered metals such as aluminum or super-alloys, and/or powdered polymers. Can 10 may be filled with inert gas 13 to create a controlled atmosphere within can 10. An example of inert gas 13 used during the can filling process may include one of nitrogen or argon. As powder 12 falls through can 10, powder 12 forms cone 14 at the bottom of can 10. During free-fall the particles of powder 12 segregate due to the size differentiation (as defined by kinetics-of-flow). The segregation further progresses during the formation of cone 14, the coarse particles of powder 12 may be free-flowing while the finer particles of powder 12 can be cohesive with a tendency to accumulate in the center of cone 14. As powder 12 falls through can 10, fine powder particles 16 are suspended in gas 13 and due to the electrostatic attraction to the walls of can 10 will with time adhere to the walls of can 10. As the filling of can 10 continues, can 10 is periodically vibrated in attempt to homogenize cone 14 and increase tap density. However, fine powder particles 16 may detach from the walls of can 10 and fall in clumps to further segregate the particles of powder 12 in cone 14.

Figure 2A:
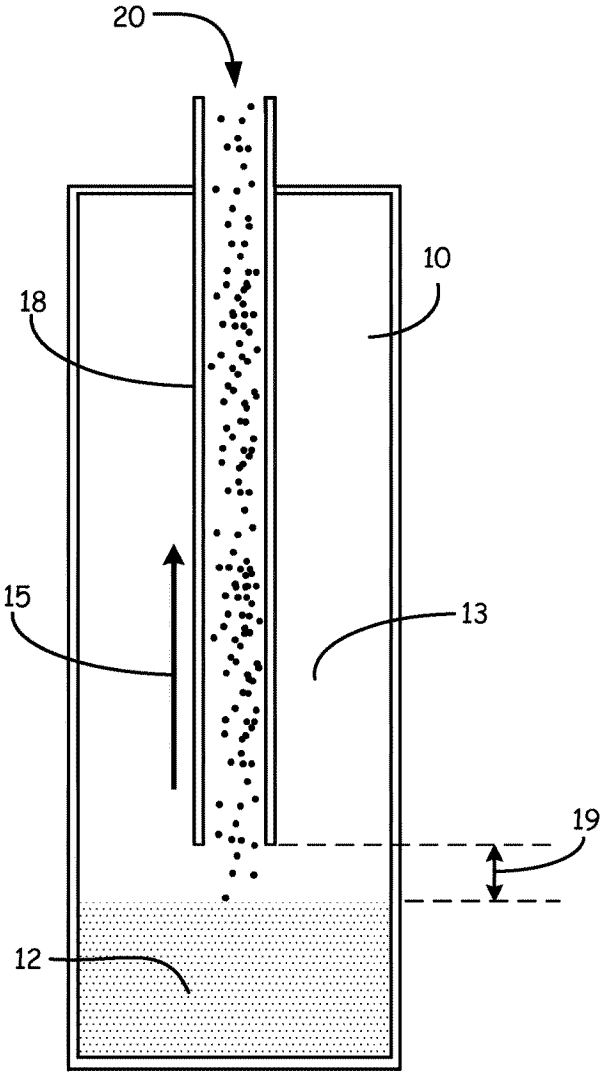
FIG. 2A is a schematic view of a can for preparing powder for a next production step according to a first embodiment of the present invention.

FIG. 2A is a schematic view of can 10 for preparing powder for a next production step according to a first embodiment of the present invention. Can 10 may be filled with inert gas 13 to create a controlled atmosphere within can 10. A low pressure vacuum may also be present in can 10. Free-falling powder 20 is introduced into can 10 through tube 18. Tube 18 is located in can 10 such that the bottom end of tube 18 extends towards the bottom of can 10. The proximity of tube 18 to powder 12 at the bottom of can 10 during the filling of can 10 is controlled in such a way as to minimize the formation of cone 14. The gap between the bottom of tube 18 and powder 12 is kept consistent during the filling of can 10 by retracting tube 18 from can 10. The retraction of tube 18 is designated by arrow 15 in FIG. 2A. Tube 18 is retracted from can 10 through mechanical, pneumatic, or hydraulic means.

As the level of powder 12 rises, tube 18 is retracted from can 10 to maintain common distance 19 between tube 18 and powder 12. Tube 18 will minimize the accumulation of fine powder particles 16 at the walls of can 10. Introduction of powder 20 into can 10 through tube 18 in close proximity to bottom of can 10 minimizes interparticle motion, eliminates cone formation of powder 20, and eliminates the suspension and plating of fine powder particles 16 on the interior surfaces of can 10. Eliminating the formation of cone 14 and the plating of fine powder particles 16 on the interior surfaces of can 10 minimizes segregation of powder 12. The decrease in segregation of powder 12 results in an increased homogeneity of powder 12 used in a process. The homogeneity of powder 12 ultimately provides a more uniform grain growth and provides more consistent mechanical properties of end product.

FIG. 2B is a schematic view of can 10 for preparing powder for a next production step according to a first embodiment of the present invention. Can 10 may be filled with inert gas 13 to create a controlled atmosphere within can 10. A low pressure vacuum may also be present in can 10. FIG. 2B shows a retracted position of tube 18. Tube 18 has been retracted as the level of powder 12 continues to rise during the can filling process. Tube 18 retracts during the can filling process so as to maintain common distance 19 between tube 18 and powder 12.

Additionally, during the filling process of can 10, can 10 is periodically vibrated in order to increase the tap density of powder 12. Tap density of powder 12 includes a volume specific weight powder 12 has after it has been settled or packed. Increased tap density of powder 12 helps to provide more consistent mechanical properties of the end product by reducing the flow inconsistencies of powder 12 with a lower tap density.

Figure 3B:
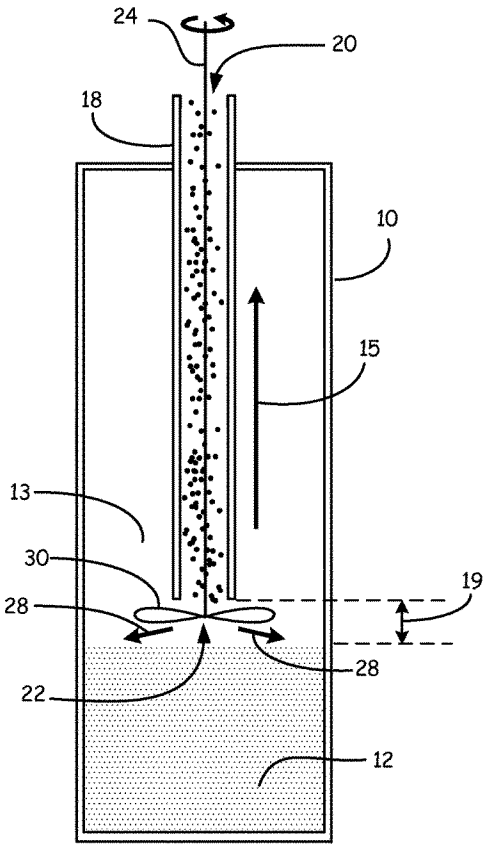
FIG. 3B is a schematic view of a can for preparing powder for a next production step according to a third embodiment of the present invention.
Figure 3A:
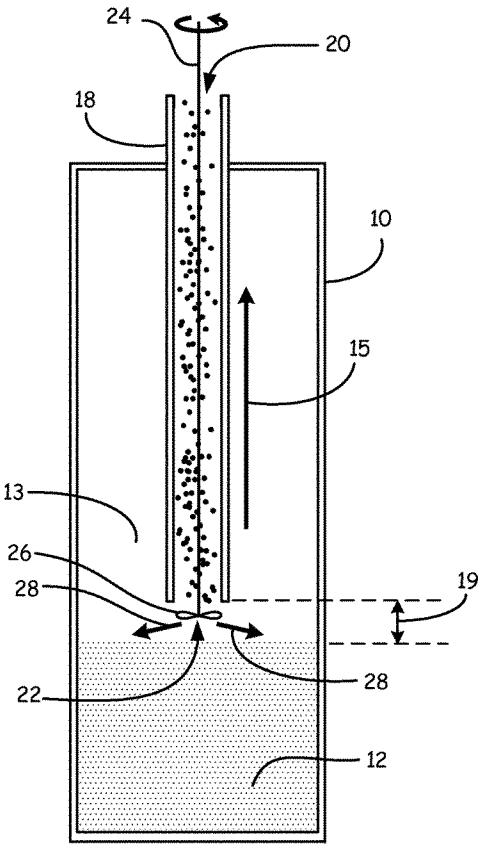
FIG. 3A is a schematic view of a can for preparing powder for a next production step according to a second embodiment of the present invention.

FIG. 3A is a schematic view of can 10 for preparing powder for a next production step according to a second embodiment of the present invention. Can 10 is filled with inert gas 13 to create a controlled atmosphere within can 10. A low pressure vacuum may also be present in can 10. Tube 18 includes fan 22. Fan 22 includes fan shaft 24 and small fan blades 26. Fan shaft 24 extends down through tube 18 and attaches to small fan blades 26. Small fan blades 26 are attached to fan shaft 24 such that small fan blades 26 are positioned below the bottom of tube 18. Small fan blades 26 continuously rotate about fan shaft 24 during the can filling process. As free-falling powder 20 exits tube 18, small fan blades 26 strike free-falling powder 20 to mechanically agitate free-falling powder 20. Operation of fan 22 disturbs the free-fall kinetics of free-falling powder 20 through mechanical agitation, creating powder dispersion 28. The mechanical agitation of free-falling powder 20 creates powder dispersion 28 and minimizes cone formation and segregation of powder 12 in can 10. The material used to form fan 22 is the same composition as powder 12, which will prevent contamination of powder 12.

Small fan blades 26 provide a mechanical agitation of free-falling powder 20 to create powder dispersion 28. Small fan blades 26 are sized so that the outer diameter of small fan blades 26 is less than the inner diameter of tube 18. Small fan blades 26 are sized smaller than the inner diameter of tube 18 so that fan 22 can be retracted through tube 18 and out of can 10. Retraction of fan 22 out of can 10 facilitates preparation for the next step in a process once the can filling process of can 10 is complete. During the filling of can 10, tube 18 is retracted from can 10 to maintain common distance 19 between tube 18 and powder 12. The retraction of tube 18 and fan 22 is designated by arrow 15 in FIG. 3A. Additionally, can 10 is periodically vibrated in order to increase the tap density of powder 12.

FIG. 3B is a schematic view of can 10 for preparing powder for a next production step according to a third embodiment of the present invention. Can 10 is filled with inert gas 13 to create a controlled atmosphere within can 10. A low pressure vacuum may also be present in can 10. Fan 22 includes fan shaft 24 and large fan blades 30. Free-flowing powder 20 is introduced into can 10 through tube 18. Large fan blades 30 provide a mechanical agitation of free-falling powder 20 to create powder dispersion 28. Large fan blades 30 are sized so that the outer diameter of large fan blades 30 is greater than the outer diameter of tube 18. Fan 22 with large fan blades 30 is retracted through tube 18 and out of can 10 by folding large fan blades 30 with a motion similar to that of an umbrella. Once large fan blades 30 are folded, the outer diameter of large fan blades 30 becomes smaller than the inner diameter of tube 18, thus allowing fan 22 to be retracted through tube 18 and out of can 10. Retraction of fan 22 out of can 10 facilitates preparation for the next step in a process once the can filling process of can 10 is complete. During the filling of can 10, tube 18 is retracted from can 10 to maintain common distance 19 between tube 18 and powder 12. The retraction of tube 18 and fan 22 is designated by arrow 15 in FIG. 3B. Additionally, can 10 is periodically vibrated in order to increase the tap density of powder 12.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

DISCUSSION OF POSSIBLE EMBODIMENTS

The following are non-exclusive descriptions of possible embodiments of the present invention.

A powder filling method includes a tube is introduced into a can so that the lower end of the tube is near the bottom of the can. A powder is introduced into the can through the tube. The proximity of the lower end of the tube to the powder in the can is controlled by retracting the tube as powder fills the can.

The powder filling method of the preceding paragraph can optionally include, additionally and/or alternatively, any one or more of the following features, configurations, and/or additional components:

the powder filling method further includes agitating the powder in the can by rotary agitation;

the rotary agitation is performed by a fan located near the lower end of the tube;

the fan comprises a same composition as the powder;

the fan is driven by a fan shaft that extends through the tube;

the tube is retracted at a rate that maintains a consistent distance between a lower end of the tube and the powder;

the tube is retracted either mechanically, pneumatically, or hydraulically;

the fan is retracted at a rate equal to the tube;

the powder filling method further includes a vacuum present in the can;

the powder filling method further includes an inert atmosphere present in the can;

the can is periodically vibrated during the powder filling of the can; and the powder comprises a metallic powder.

A powder filling method includes a tube introduced into a can. A powder is supplied through the tube to fill the can. The tube is retracted as the powder fills the can to maintain a consistent distance between a lower end of the tube and the powder. The powder is agitated in the can by rotary agitation.

The powder filling method of the preceding paragraph can optionally include, additionally and/or alternatively, any one or more of the following features, configurations, and/or additional components:

the powder filling method further includes the rotary agitation performed by a fan;

the fan comprises a same composition as the powder;

the powder is agitated as it exits the tube;

the fan is driven by a shaft that extends through the tube;

the fan is retracted at a rate equal to the tube;

the tube is retracted either mechanically, pneumatically, or hydraulically;

the powder filling method further includes a vacuum present in the can;

the powder filling method further includes an inert atmosphere present in the can; and the can is periodically vibrated during the powder filling of the can.

The invention claimed is:

1. A powder filling method comprising:

introducing a tube into a can so that the lower end of the tube is near a bottom of the can, wherein at least one of a low pressure vacuum and an inert gas is present in the can;

introducing powder into the can through the tube;

agitating the powder in the can by rotary agitation with a fan with fan blades, wherein an outer diameter of the fan blades is less than an inner diameter of the tube; and controlling proximity of the lower end of the tube to the powder in the can by retracting the tube as powder fills the can.

2. The powder filling method according to claim 1, wherein the rotary agitation is performed by the fan located near the lower end of the tube.

3. The powder filling method according to claim 2, wherein the fan comprises a same composition as the powder.

4. The powder filling method according to claim 2, wherein the fan is driven by a fan shaft that extends through the tube.

5. The powder filling method according to claim 2, wherein the tube is retracted at a rate that maintains a consistent distance between a lower end of the tube and the powder.

6. The powder filling method according to claim 1, wherein the tube is retracted either mechanically, pneumatically, or hydraulically.

7. The powder filling method according to claim 5, wherein the fan is retracted at a rate equal to the tube.

8. The powder filling method according to claim 1, wherein an inert atmosphere is present in the can.

9. The powder filling method according to claim 1, wherein the can is periodically vibrated during the powder filling of the can.

10. The powder filling method according to claim 1, wherein the powder comprises a metallic powder.

11. The powder filling method according to claim 1, further comprising retracting the fan through the tube and out of the can.

12. A powder filling method comprising the steps of:

introducing a tube into a can, wherein at least one of a low pressure vacuum and an inert gas is present in the can;

supplying powder through the tube to fill the can;

retracting the tube as the powder fills the can to maintain a consistent distance between a lower end of the tube and the powder;

agitating the powder in the can by rotary agitation with a fan with fan blades; and retracting the fan through the tube and out of the can.

13. The powder filling method according to claim 12 , wherein the fan comprises a same composition as the powder.

14. The powder filling method according to claim 12, wherein the powder is agitated as it exits the tube.

15. The powder filling method according to claim 12, wherein the fan is driven by a shaft that extends through the tube.

16. The powder filling method according to claim 12, wherein the fan is retracted at a rate equal to the tube.

17. The powder filling method according to claim 12, wherein the tube is retracted either mechanically, pneumatically, or hydraulically.

18. The powder filling method according to claim 12, wherein an inert atmosphere is present in the can.

19. The powder filling method according to claim 12, wherein the can is periodically vibrated during the powder filling of the can.

20. The powder filling method according to claim 12, further comprising folding the fan blades so that an outer diameter of the fan blades becomes smaller than an inner diameter of the tube.

* * * * *